US009891578B2

(12) United States Patent
Gilliam et al.

(10) Patent No.: US 9,891,578 B2
(45) Date of Patent: Feb. 13, 2018

(54) CLEANER BLADE SEALING IN AN ELECTROPHOTOGRAPHIC IMAGE FORMING DEVICE

(71) Applicant: LEXMARK INTERNATIONAL, INC., Lexington, KY (US)

(72) Inventors: Trey Dustin Gilliam, Lexington, KY (US); Brian Hawes, Lexington, KY (US); Ahren Michael Hoy, Charlotte, NC (US); Michael David Maul, Waxhaw, NC (US); Joshua Carl Poterjoy, Bainbridge, PA (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/344,658

(22) Filed: Nov. 7, 2016

(65) Prior Publication Data

US 2017/0185028 A1 Jun. 29, 2017

Related U.S. Application Data

(60) Provisional application No. 62/272,126, filed on Dec. 29, 2015.

(51) Int. Cl.
*G03G 21/00* (2006.01)

(52) U.S. Cl.
CPC ..... *G03G 21/0011* (2013.01)

(58) Field of Classification Search
CPC ..... G03G 21/0011; G03G 21/0029
See application file for complete search history.

(56) References Cited

U.S. PATENT DOCUMENTS

| | | | | |
|---|---|---|---|---|
| 4,323,306 | A * | 4/1982 | Ito | G03G 21/0011 15/256.51 |
| 5,442,422 | A | 8/1995 | Owens, Jr. et al. | |
| 5,502,547 | A * | 3/1996 | Shirai | G03G 15/0817 399/102 |
| 5,517,294 | A * | 5/1996 | Ogiri | G03G 21/0011 399/351 |
| 6,553,195 | B2 | 4/2003 | Korfhage et al. | |
| 7,668,482 | B2 * | 2/2010 | Ushikubo | G03G 15/0225 399/123 |
| 8,792,801 | B2 * | 7/2014 | Akamatsu | G03G 21/0029 399/102 |
| 8,886,080 | B2 | 11/2014 | Allen et al. | |
| 2004/0120728 | A1 * | 6/2004 | Ziegelmuller | G03G 21/0011 399/123 |
| 2005/0185980 | A1 * | 8/2005 | Okamoto | G03G 15/065 399/103 |

(Continued)

*Primary Examiner* — David Bolduc
(74) *Attorney, Agent, or Firm* — Justin M. Tromp

(57) ABSTRACT

A cleaner assembly according to one embodiment includes a cleaner blade that extends upward in a cantilevered manner and that includes a cleaning edge for contacting a surface to remove toner from the surface. A waste toner sump is positioned adjacent to a rear side of the cleaner blade for storing toner removed from the surface by the cleaner blade. A film seal extends in a cantilevered manner toward the rear side of the cleaner blade and contacts the rear side of the cleaner blade along a longitudinal length of the cleaner blade. A foam seal is positioned between the rear side of the cleaner blade and the wall below the contact between the rear side of the cleaner blade and the film seal. The foam seal extends along the longitudinal length of the cleaner blade.

15 Claims, 13 Drawing Sheets

(56) References Cited

U.S. PATENT DOCUMENTS

| | | | | |
|---|---|---|---|---|
| 2005/0214045 | A1* | 9/2005 | Ohta | G03G 21/0011 399/350 |
| 2006/0024100 | A1* | 2/2006 | Ohta | G03G 21/0011 399/350 |
| 2006/0204297 | A1* | 9/2006 | Honda | G03G 21/10 399/349 |
| 2007/0217843 | A1* | 9/2007 | Ichikawa | G03G 21/0011 399/350 |
| 2008/0152408 | A1* | 6/2008 | Kawakami | G03G 21/0011 399/351 |
| 2008/0187353 | A1* | 8/2008 | Moon | G03G 15/0813 399/103 |
| 2008/0260439 | A1* | 10/2008 | Awaya | G03G 21/0035 399/349 |
| 2009/0097893 | A1* | 4/2009 | Kiuchi | G03G 21/0011 399/350 |
| 2009/0245904 | A1* | 10/2009 | Maruyama | G03G 21/0011 399/350 |
| 2009/0269106 | A1* | 10/2009 | Fujii | G03G 15/0813 399/264 |
| 2010/0028045 | A1* | 2/2010 | Kawakami | G03G 21/0011 399/123 |
| 2012/0114403 | A1* | 5/2012 | Takenouchi | G03G 15/161 399/350 |
| 2012/0163855 | A1* | 6/2012 | Seo | G03G 15/0813 399/102 |
| 2013/0287429 | A1* | 10/2013 | Allen | G03G 21/0029 399/102 |
| 2014/0072326 | A1* | 3/2014 | Yamaguchi | G03G 21/0011 399/102 |
| 2016/0062303 | A1* | 3/2016 | Hayashi | G03G 21/0011 399/350 |

* cited by examiner

CLEANER BLADE SEALING IN AN ELECTROPHOTOGRAPHIC IMAGE FORMING DEVICE

CROSS REFERENCES TO RELATED APPLICATIONS

This application claims priority to U.S. Provisional Patent Application Ser. No. 62/272,126, filed Dec. 29, 2015, entitled "Cleaner Blade Sealing for an Electrophotographic Image Forming Device," the content of which is hereby incorporated by reference in its entirety.

BACKGROUND

1. Field of the Disclosure

The present disclosure relates generally to image forming devices and more particularly to cleaner blade sealing for an electrophotographic image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the photoconductive drum. The toned image is transferred to the print media (e.g., paper) either directly by the photoconductive drum in a one-step transfer system or indirectly by an intermediate transfer member in a two-step transfer system. The toner is then fused to the media using heat and pressure to complete the print. Not all of the toner picked up by the photoconductive drum is transferred to the print media or intermediate transfer member due to inefficiencies in the image transfer process. Waste or residual toner left on the photoconductive drum after the photoconductive drum has contacted the print media or intermediate transfer member is removed before the next image is formed in order to avoid contamination of the next image. For this purpose, a cleaner blade in contact with the photoconductive drum (and, in a two-step transfer system, the intermediate transfer member) removes the waste toner from its surface. The waste toner cleaned from the surface of the photoconductive drum initially falls to a temporary waste toner sump and is then moved to a permanent waste toner reservoir where it is stored. It is important to seal the waste toner in the area around the cleaner blade and the waste toner sump in order to prevent leakage. Sealing in this area can be particularly difficult in image forming devices having a pivoting cleaner blade.

SUMMARY

A photoconductor unit for an electrophotographic image forming device according to one example embodiment includes a housing and a photoconductive drum rotatably mounted on the housing. The photoconductive drum includes a rotational axis. A cleaner blade extends longitudinally along the rotational axis of the photoconductive drum and includes a pair of longitudinal ends. The cleaner blade includes a front side that faces the photoconductive drum and a rear side opposite the front side. The cleaner blade extends upward in a cantilevered manner toward the photoconductive drum and includes a cleaning edge that contacts a surface of the photoconductive drum to remove toner from the surface of the photoconductive drum. A waste toner sump is positioned adjacent to the rear side of the cleaner blade. The waste toner sump stores toner removed from the surface of the photoconductive drum by the cleaner blade. A rear seal assembly seals between the rear side of the cleaner blade and a wall of the housing that is positioned proximate to a front portion of the waste toner sump. The rear seal assembly includes a film seal that extends in a cantilevered manner toward the rear side of the cleaner blade and that contacts the rear side of the cleaner blade along a longitudinal length of the cleaner blade. The rear seal assembly includes a second seal positioned between the rear side of the cleaner blade and the wall of the housing below the contact between the rear side of the cleaner blade and the film seal. The second seal extends along the longitudinal length of the cleaner blade.

A photoconductor unit for an electrophotographic image forming device according to another example embodiment includes a housing and a photoconductive drum rotatably mounted on the housing. The photoconductive drum includes a rotational axis. A cleaner blade is mounted on a bracket that is mounted on the housing. The cleaner blade extends longitudinally along the rotational axis of the photoconductive drum and includes a pair of longitudinal ends. The cleaner blade includes a front side that faces the photoconductive drum and a rear side opposite the front side. The cleaner blade extends in a cantilevered manner from the bracket toward the photoconductive drum and includes a cleaning edge that contacts a surface of the photoconductive drum to remove toner from the surface of the photoconductive drum. The cleaner blade and the bracket are pivotable relative to the photoconductive drum about a pivot axis that is parallel to the rotational axis of the photoconductive drum. A rear seal assembly seals between the rear side of the cleaner blade and a wall of the housing. The rear seal assembly includes a film seal that extends in a cantilevered manner toward the rear side of the cleaner blade and that contacts the rear side of the cleaner blade along a longitudinal length of the cleaner blade. The rear seal assembly includes a foam seal positioned between the rear side of the cleaner blade and the wall of the housing. The foam seal extends along the longitudinal length of the cleaner blade and is positioned against the bracket.

A cleaner assembly for an electrophotographic image forming device according to one example embodiment includes a cleaner blade having a pair of longitudinal ends. The cleaner blade extends upward in a cantilevered manner and includes a cleaning edge that extends between the pair of longitudinal ends for contacting a surface to remove toner from the surface. A waste toner sump is positioned adjacent to a rear side of the cleaner blade. The waste toner sump stores toner removed from the surface by the cleaner blade. A seal assembly seals between the rear side of the cleaner blade and a wall of the waste toner sump. The seal assembly includes a film seal that extends in a cantilevered manner toward the rear side of the cleaner blade and that contacts the rear side of the cleaner blade along a longitudinal length of the cleaner blade. The seal assembly includes a foam seal positioned between the rear side of the cleaner blade and the wall below the contact between the rear side of the cleaner blade and the film seal. The foam seal extends along the longitudinal length of the cleaner blade.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
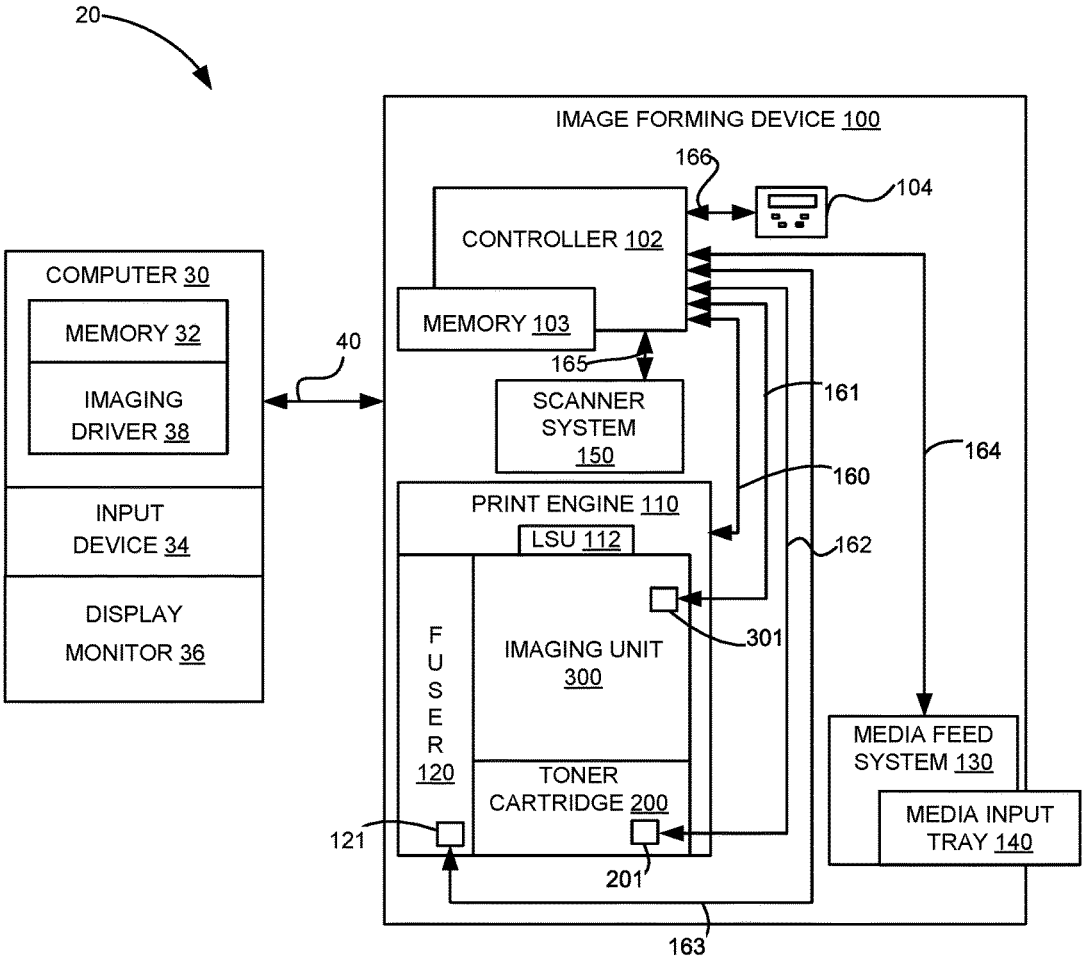
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 20( )and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may include a processor and associated memory such as RAM, ROM, and/or NVRAM and may provide authentication functions, safety and operational interlocks, operating parameters and usage information related to fuser 120, toner cartridge(s) 200 and imaging unit(s) 300, respectively. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
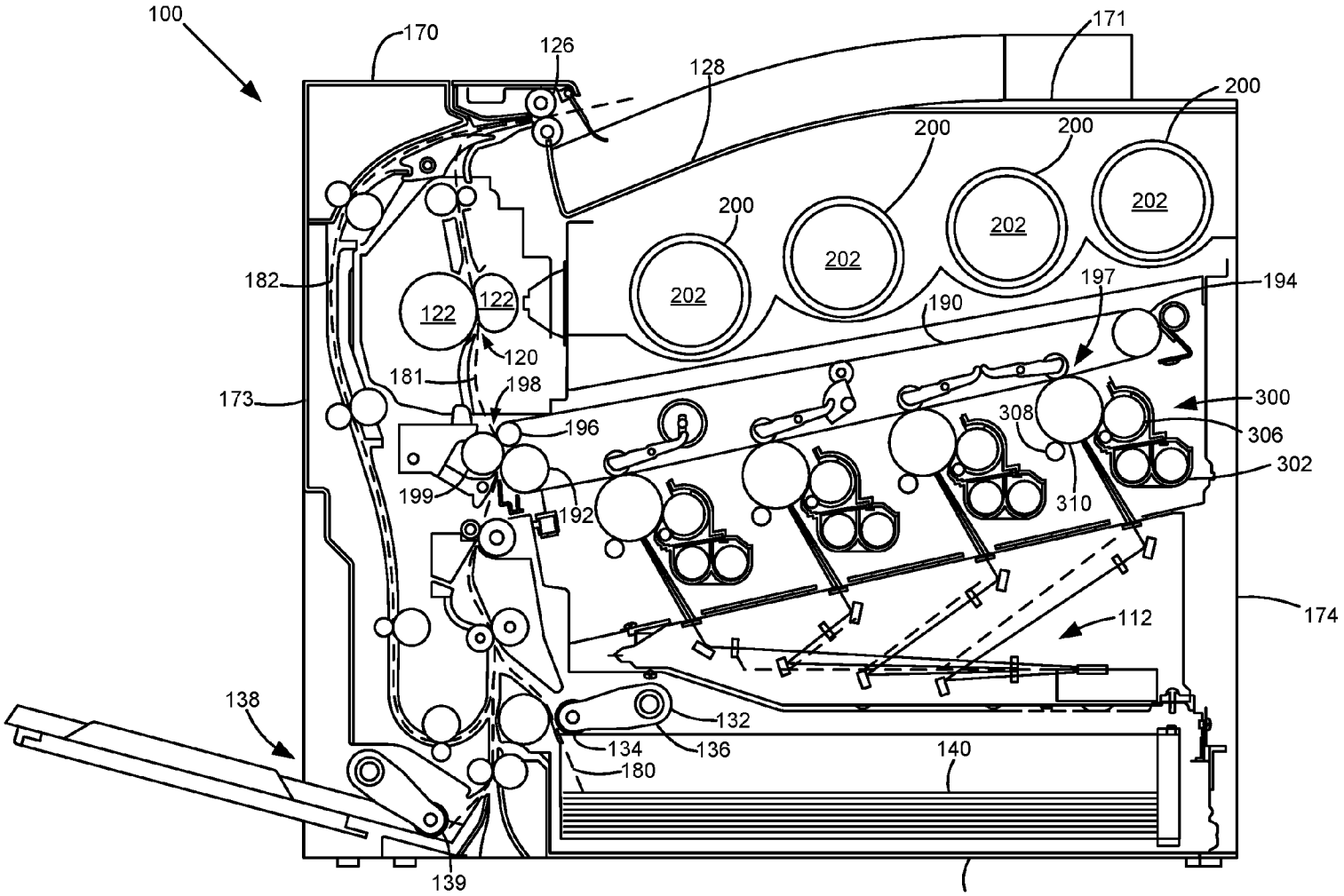
FIG. 2 is a schematic diagram of an image forming device according to one example embodiment.

FIG. 2 illustrates a schematic view of the interior of an example image forming device 100. For purposes of clarity, the components of only one of the imaging units 300 are labeled in FIG. 2. Image forming device 100 includes a housing 170 having a top 171, bottom 172, front 173, rear 174 and a pair of sides (one facing out of the page and one facing into the page as viewed in FIG. 2). Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300, which are also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. In the example embodiment illustrated, each toner cartridge 200 is substantially the same except for the color of toner contained therein. In one embodiment, the four toner cartridges 200 contain yellow, cyan, magenta and black toner, respectively.

In the example embodiment illustrated, image forming device 100 utilizes what is commonly referred to as a dual component development system. Each imaging unit 300 includes a reservoir 302 that stores a mixture of toner and magnetic carrier beads. The carrier beads may be coated with a polymeric film to provide triboelectric properties to attract toner to the carrier beads as the toner and the carrier beads are mixed in reservoir 302. Reservoir 302 and a magnetic roll 306 collectively form a developer unit. Magnetic roll 306 includes a stationary core that includes one or more permanent magnets and a rotatable sleeve that encircles the core. Reservoir 302 may include toner agitators, such as paddles, augers, etc., that stir the developer mix and present the developer mix to magnetic roll 306. Each imaging unit 300 also includes a charge roll 308, a photoconductive drum (PC drum) 310 and a cleaner blade (not shown) that collectively form a photoconductor unit. PC drums 310 are mounted substantially parallel to each other when the imaging units 300 are installed in image forming device 100. In the example embodiment illustrated, each imaging unit 300 is substantially the same except for the color of toner contained therein.

Each charge roll 308 forms a nip with the corresponding PC drum 310. During a print operation, charge roll 308 charges the surface of PC drum 310 to a specified voltage, such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. The permanent magnets) of magnetic roll 306 attract the carrier beads in reservoir 302 having toner thereon to the outer surface of the sleeve of magnetic roll 306. The sleeve of magnetic roll 306 transports the carrier beads having toner thereon past a trim bar that trims the mix of carrier beads and toner to a predetermined average height on the outer surface of the sleeve. The sleeve of magnetic roll 306 then transports the carrier beads having toner thereon to the corresponding PC drum 310. Electrostatic forces from the latent image on PC drum 310 strip the toner from the carrier beads to form a toner image on the surface of PC drum 310.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a respective first transfer nip 197. in one embodiment, a positive voltage field attracts the toner images from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196. The cleaner blade/roll removes any toner remnants on PC drum 310 so that the surface of PC drum 310 may be charged and developed with toner again.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

While the example image forming device 100 shown in FIG. 2 illustrates four toner cartridges 200 and four corresponding imaging units 300, it will be appreciated that a monocolor image forming device 100 may include a single toner cartridge 200 and corresponding imaging unit 300 as compared to a multicolor image forming device 100 that may include multiple toner cartridges 200 and imaging units 300. Further, although image forming device 100 utilizes ITM 190 to transfer toner to the media, toner may be applied directly to the media by the one or more photoconductive drums 310 as is known in the art.

While the example image forming device 100 shown in FIG. 2 utilizes a dual component development system, in another embodiment, image forming device 100 utilizes what is commonly referred to as a single component development system. In this embodiment, a toner adder roll in each developer unit has an outer surface that is in contact with and forms a nip with the outer surface of a corresponding developer roll. As the toner adder roll and the developer roll rotate, the toner adder roll supplies toner in reservoir 302 to the developer roll. The developer roll is electrically charged and electrostatically attracts the toner particles supplied by the toner adder roll. A doctor blade positioned along each developer roll provides a substantially uniform layer of toner on the developer roll. The outer surface of the developer roll is also in contact with and forms a nip with the outer surface of a corresponding PC drum 310. As the developer roll and PC drum 310 rotate, toner particles are electrostatically transferred from the developer roll to the latent image on PC drum 310 forming a toned image on the surface of PC drum 310. PC drum 310 is charged by charge roll 308 and cleaned by a cleaner blade as discussed above.

Figure 3:
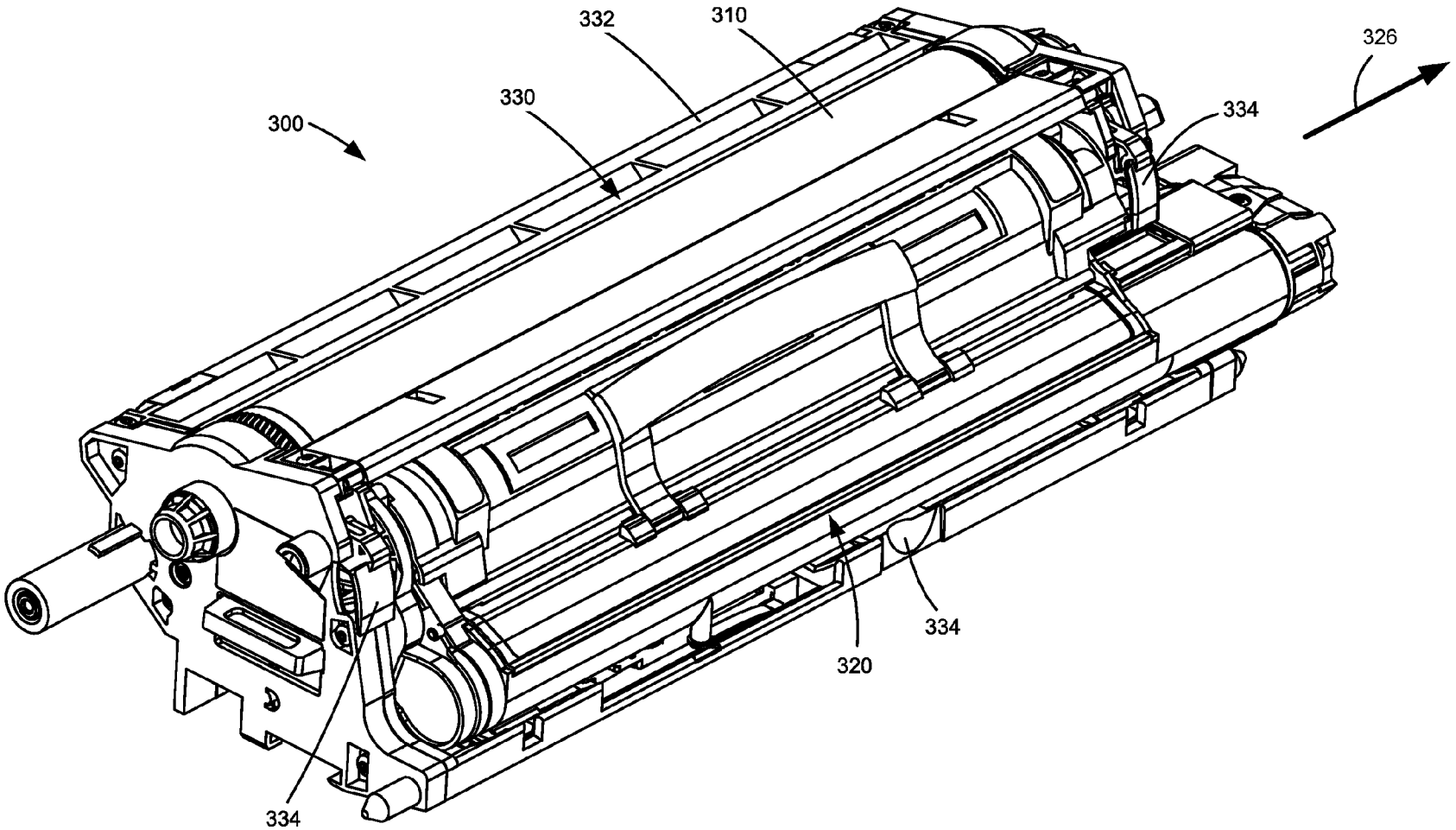
FIG. 3 is a perspective view of an imaging unit including a developer unit and a photoconductor unit according to one example embodiment.
Figure 4:
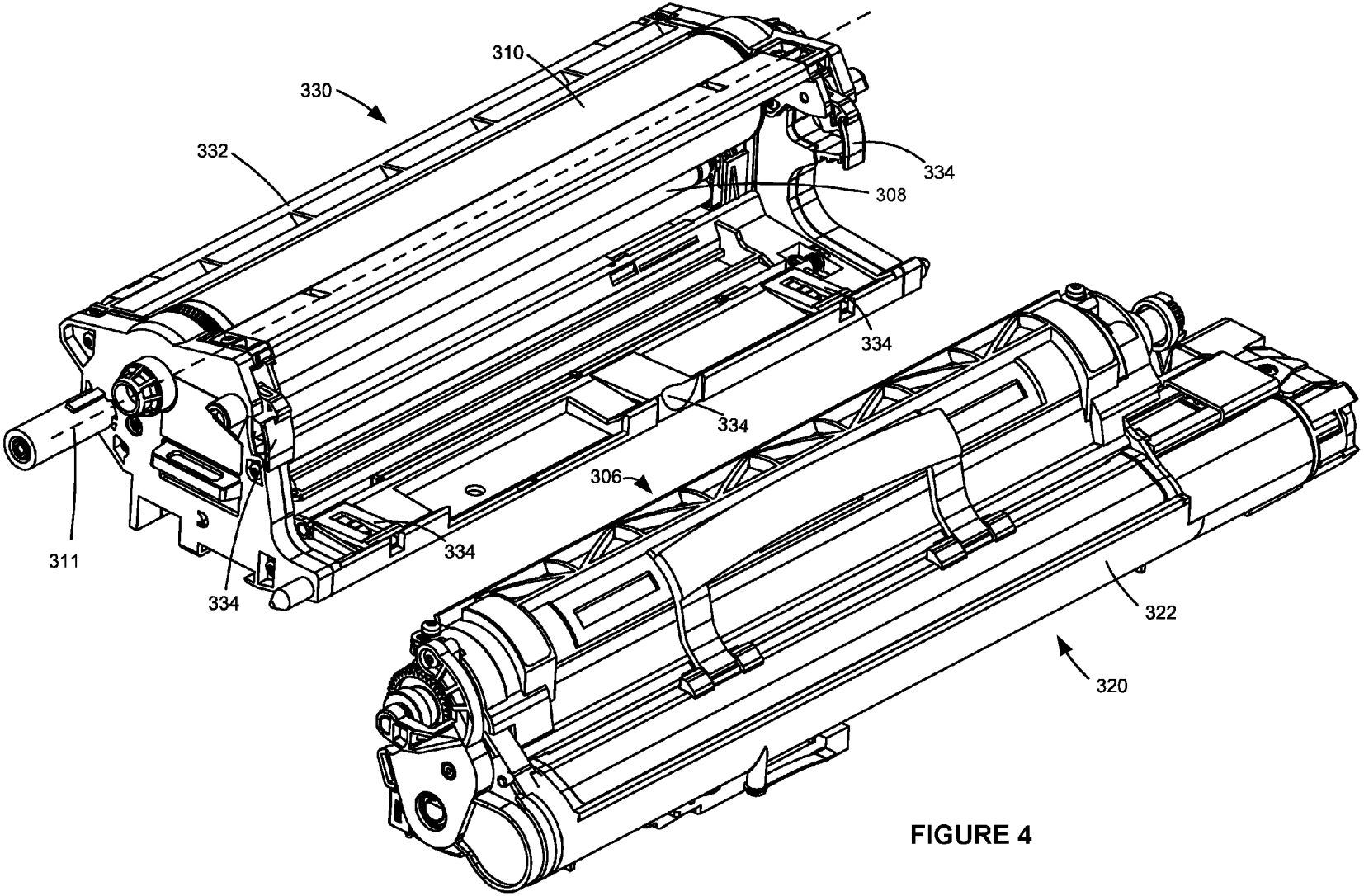
FIG. 4 is a perspective view of the imaging unit showing the developer unit separated from the photoconductor unit according to one example embodiment.

FIGS. 3 and 4 show imaging unit 300 according to one example embodiment. Imaging unit 300 includes a developer unit 320 and a photoconductor unit (PC unit) 330. In the example embodiment illustrated, developer unit 320 is removably coupled to PC unit 330 to permit repair or replacement of developer unit 320 independent of PC unit 330 and vice versa. In other embodiments, developer unit 320 and PC unit 330 are fixed together such that imaging unit 300 is replaced as a single unit. In the example embodiment illustrated, developer unit 320 and PC unit 330 are replaced independent of toner cartridge 200. In other embodiments, toner cartridge 200, developer unit 320 and PC unit 330 are replaced as a single unit. Additional configurations of toner cartridge 200, developer unit 320 and PC unit 330 may be used as desired. PC unit 330 includes a housing 332 having PC drum 310 as well as charge roll 308 and a cleaner blade mounted thereto. Housing 332 extends generally along a rotational axis 311 of PC drum 310. Housing 332 may also include one or more user-actuated latches 334 that couple developer unit 320 to PC unit 330 as shown in FIG. 3 for operation in image forming device 100 and that permit a user to separate developer unit 320 from PC unit 330 when imaging unit 300 is removed from image forming device 100 as shown in FIG. 4. Developer unit 320 includes a housing 322 having reservoir 302 therein. Housing 322 extends generally along a rotational axis of magnetic roll 306, which is substantially parallel to rotational axis 311 of PC drum 310. A portion of magnetic roll 306 is exposed from reservoir 302 at one side of housing 322 for mating with PC drum 310 when developer unit 320 is coupled to PC unit 330. When developer unit 320 is coupled to PC unit 330, imaging unit 300 is insertable into image forming device 100 via a sliding motion along an insertion direction 326 as indicated in FIG. 3.

Figure 5:
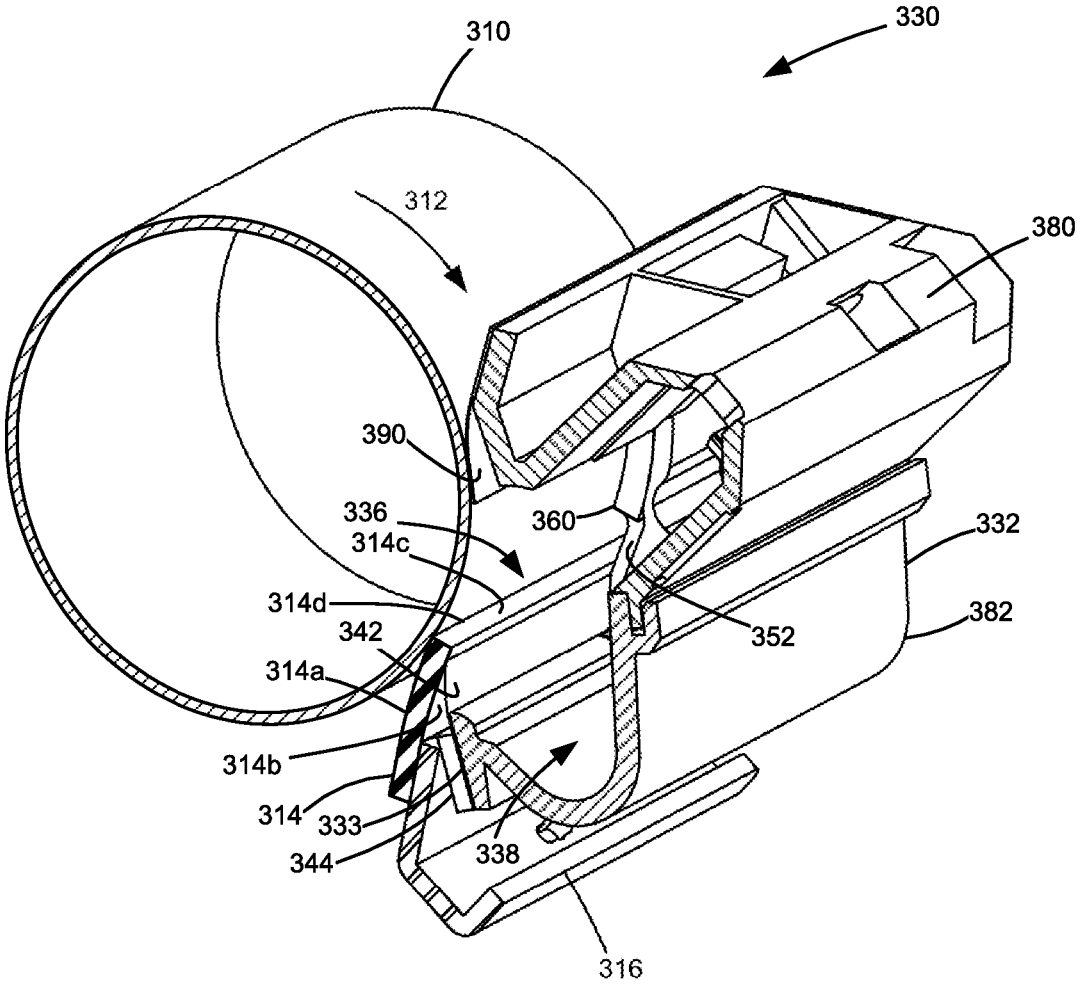
FIG. 5 is a cross sectional perspective view of a portion of the photoconductor unit showing the engagement between a cleaner blade and a photoconductive drum according to one example embodiment.

FIG. 5 shows a portion of PC unit 330 at a first axial end portion of PC drum 310 with the remainder of PC drum 310 and housing 332, which would extend to the left as viewed in FIG. 5, cut off to more clearly illustrate the components at the axial end of PC drum 310. The opposite axial end of PC drum 310 and housing 332 is a mirror image of the axial end shown. An operative rotational direction 312 of PC drum 310 is indicated by the arrow shown in FIG. 5. A cleaner blade 314 is mounted on housing 332 and extends longitudinally along the axial length of PC drum 310 to remove toner remnants from the surface of PC drum 310 as discussed above. The length of cleaner blade 314 (in the axial direction of PC drum 310) spans at least the largest toner image possible on the outer surface of PC drum 310, which may be defined by, for example, the span of the laser beam of LSU 112 that creates the latent image on the surface of PC drum 310 or by the axial length of charge roll 308. Cleaner blade 314 extends in a cantilevered manner from a bracket 316 mounted on housing 332. In the embodiment illustrated, cleaner blade 314 extends upward at an angle from bracket 316 toward PC drum 310. Cleaner blade 314 includes a front side 314*a* that faces PC drum 310 and a rear side 314*b* opposite front side 314*a*. A free end 314*c* of cleaner blade 314 includes a cleaning edge 314*d* that contacts the surface of PC drum 310 at a cleaner blade-PC drum nip 336 and removes toner from the surface of PC drum 310. Toner removed from PC drum 310 by cleaner blade 314 falls into a waste toner sump 338 positioned on the rear side 314*b* of cleaner blade 314 where the waste toner is temporarily stored before being moved, e.g., by an auger, to a larger waste toner reservoir.

Figure 6:
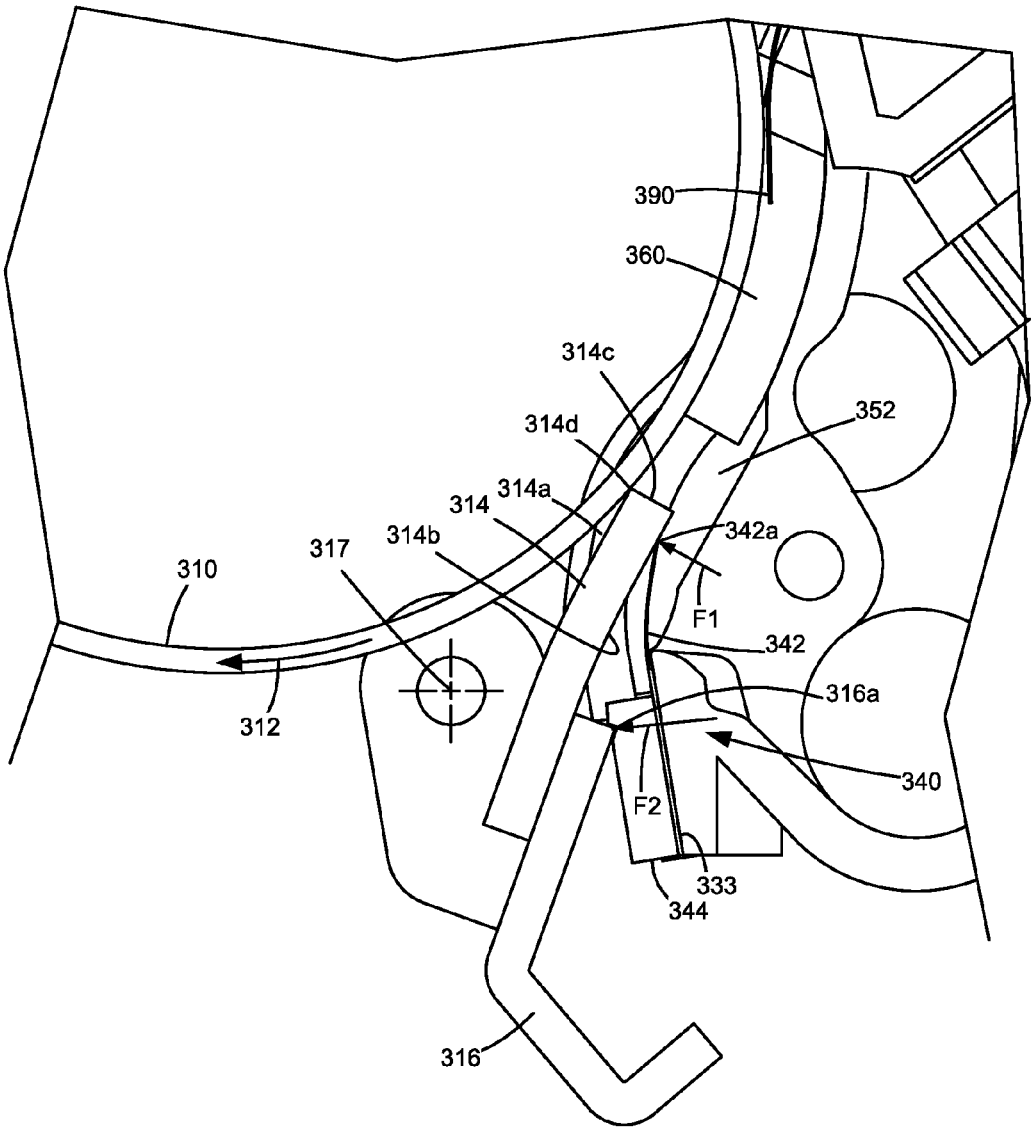
FIG. 6 is a cross sectional view of a portion of the photoconductor unit shown in FIG. 5 showing a rear seal assembly according to one example embodiment.

FIG. 6 shows a cross-sectional view of PC drum 310 and cleaner blade 314 illustrating the engagement between cleaner blade 314 and PC drum 310. With reference to FIGS. 5 and 6, in one embodiment, bracket 316 is pivotally mounted to housing 332 such that cleaner blade 314 and bracket 316 are pivotable relative to PC drum 310 about a pivot axis 317 that is parallel to rotational axis 311 of PC drum 310. A rear seal assembly 340 is positioned on rear side 314*b* of cleaner blade 314. Rear seal assembly 340 restricts toner remnants removed. from the surface of PC drum 310 by cleaner blade 314 from leaking between a wall 333 of housing 332 at the front of waste toner sump 338 (proximate to PC drum 310 and cleaner blade 314) and rear side 314*b* of cleaner blade 314 and bracket 316.

Rear seal assembly 340 includes a flexible film seal 342 that extends in a cantilevered manner from wall 333 toward rear side 314*b* of cleaner blade 314. Film seal 342 may be composed of any relatively firm, low friction film, such as Mylar or urethane. Film seal 342 may be adhered to the front side of wall 333. Film seal 342 extends along the longitudinal length of cleaner blade 314. A free end 342*a* of film seal 342 contacts rear side 314*b* of cleaner blade 314 near free end 314*c* of cleaner blade 314. In some embodiments, film seal 342 has a sufficient cantilevered length and is angled relative to cleaner blade 314 such that free end 342*a* of film seal 342 has an interference contact with rear side 314*b* of cleaner blade 314 through the entire range of pivoting motion of cleaner blade 314 such that free end 342*a* is deflected against rear side 314*b* of cleaner blade 314. Film seal 342 aids in preventing toner from leaking between wall 333 and rear side 314*b* of cleaner blade 314. The thin, flexible film seal 342 imparts a relatively low force, indicated by arrow F1 in FIG. 6, on cleaner blade 314. In those embodiments where cleaner blade 314 is pivotable, a lower force is desired in order to prevent the force applied to cleaner blade 314 by film seal 342 from impeding the motion of cleaner blade 314 or affecting the force of cleaner blade 314 on PC drum 310 at nip 336.

In the embodiment illustrated, rear seal assembly 340 also includes a foam seal 344 positioned between rear side 314*b* of cleaner blade 314 and wall 333. Foam seal 344 extends along the longitudinal length of cleaner blade 314 and is positioned against the rear side of cleaner blade 314 or bracket 316. In the embodiment illustrated, foam seal 344 is positioned against the rear side of bracket 316. Foam seal 344 is positioned below the contact between film seal 342 and cleaner blade 314 to catch any toner that falls between film seal 342 and rear side 314*b* of cleaner blade 314. Foam seal 344 may be adhered to the front side of wall 333 and/or to film seal 342. In one embodiment, foam seal 344 and film seal 342 are laminated together forming a unitary construction and are adhered to the front side of wall 333. In the example embodiment illustrated, foam seal 344 has an interference contact with bracket 316 along a top, rear edge 316*a* of bracket 316. Interference with bracket 316 along its top, rear edge 316*a* reduces the force, indicated by the arrow F2 in FIG. 6, of foam seal 344 on cleaner blade 314. As discussed above, a lower force is desired in order to prevent the force applied to cleaner blade 314 by foam seal 344 from impeding the motion of cleaner blade 314 or affecting the force of cleaner blade 314 on PC drum 310 at nip 336. In the embodiment illustrated, the direction of the force F2 on bracket 316 by foam seal 344 is close to pivot axis 317 of cleaner blade 314 thereby reducing the impact of any variability of the force from foam seal 344 on cleaner blade 314. Further, placement of sealing force F2 of foam seal 344 slightly below pivot axis 317 of cleaner blade 314 and sealing force F1 of film seal 342 above pivot axis 317 of cleaner blade 314 allows a net reduction of the total moment on cleaner blade 314 from rear seal assembly 340 in order to avoid impeding the motion of cleaner blade 314 or affecting the force of cleaner blade 314 on PC drum 310 at nip 336. Foam seal 344 may be composed of an open or closed cell foam. In some embodiments, an open cell foam is advantageous because open cell foam is generally softer than closed cell foam and, therefore, applies less force on bracket 316 than a closed cell foam would. In other embodiments, rear seal assembly 340 includes a second flexible film seal (not shown) that contacts the rear side 314*b* of cleaner blade 314 below the contact between film seal 342 and cleaner blade 314 in order to further aid in preventing toner from leaking between wall 333 and rear side 314*b* of cleaner blade 314. The second film seal may be used in place or in addition to foam seal 344.

Figure 7:
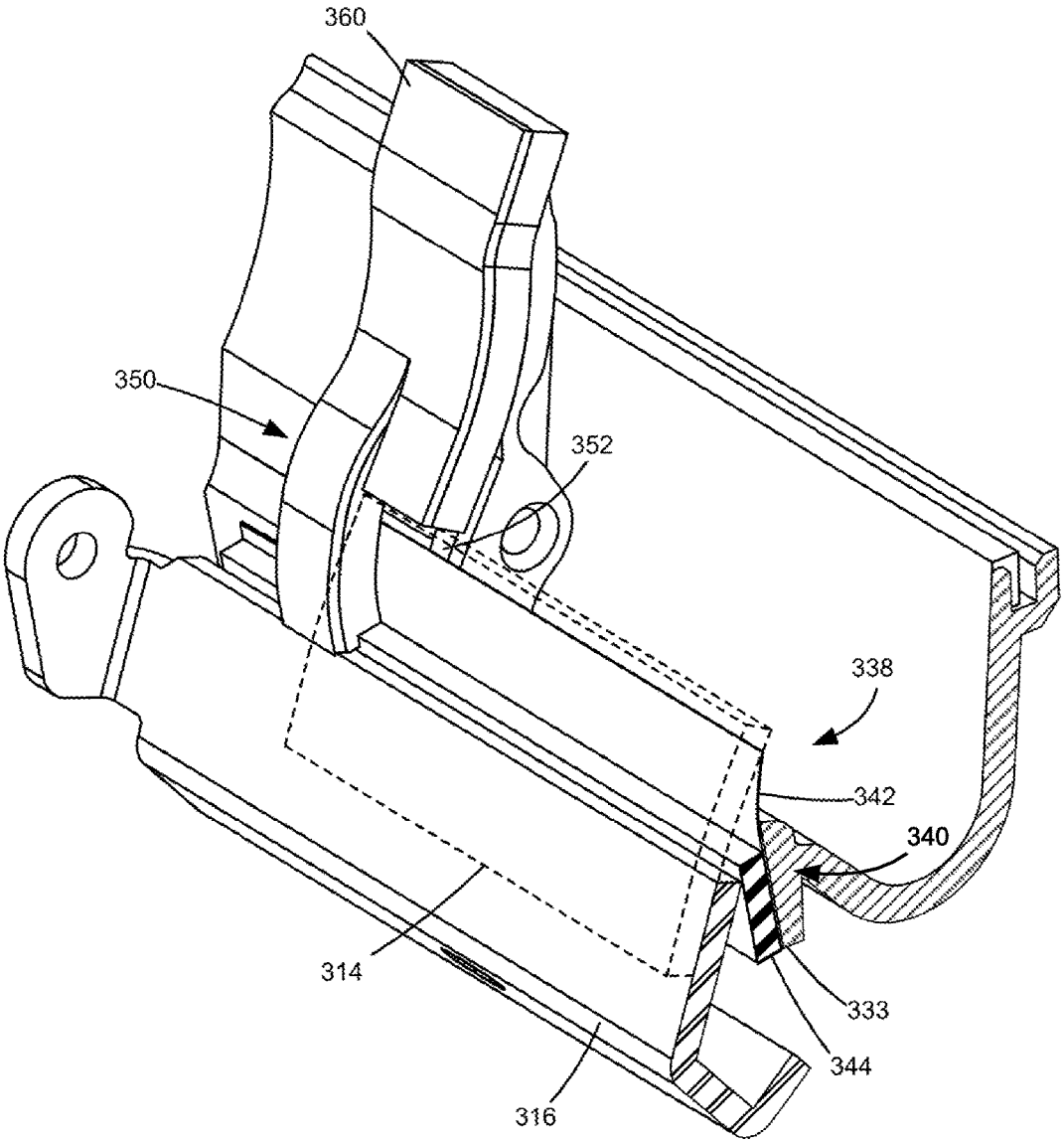
FIG. 7 is a perspective view of an end seal assembly of the photoconductor unit according to one example embodiment.
Figure 8:
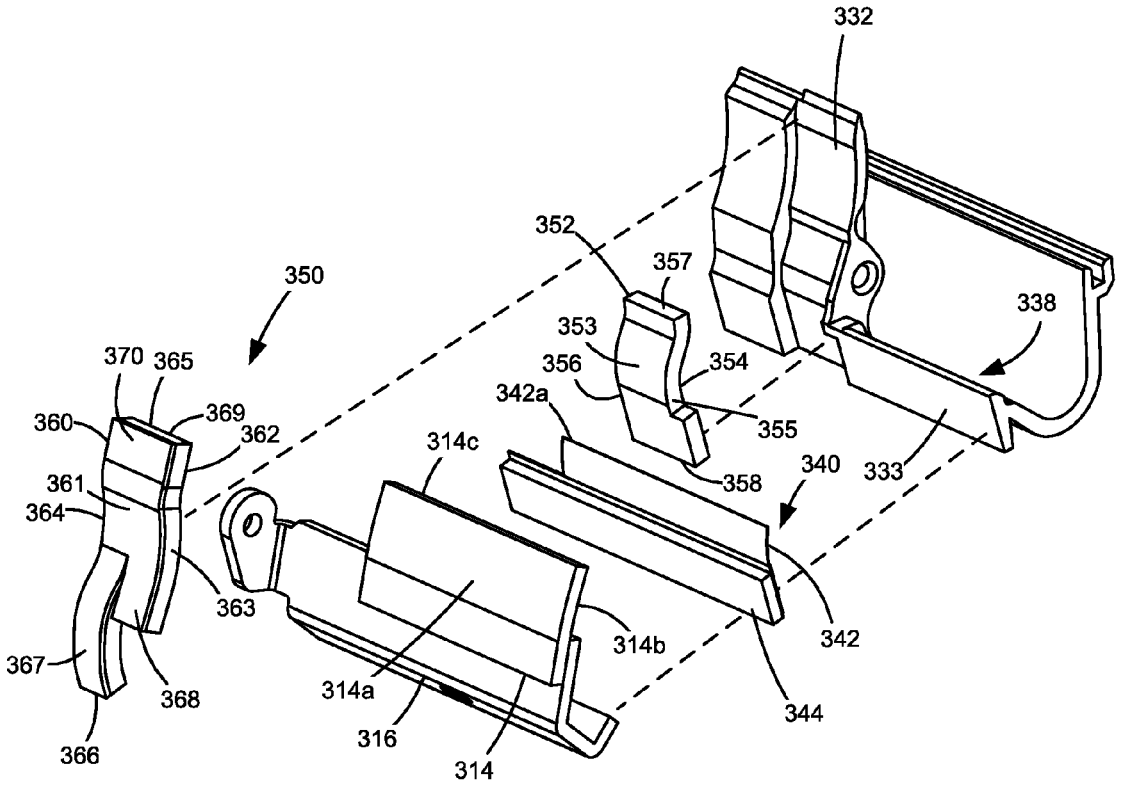
FIG. 8 is an exploded view of the end seal assembly and the rear seal assembly according to one example embodiment.

FIG. 7 shows a perspective view of an end seal assembly 350 that is positioned. at each axial end of PC drum 310 and longitudinal end of cleaner blade 314 to prevent toner from leaking beyond the axial ends of PC drum 310 and the longitudinal ends of cleaner blade 314. Cleaner blade 314 is shown in broken line in FIG. 7 in order to more clearly illustrate the components positioned behind cleaner blade 314. PC drum 310 is omitted from FIG. 7 for clarity. FIG. 8 shows an exploded view of end seal assembly 350 and rear seal assembly 340 at one longitudinal end of cleaner blade 314. With reference to FIGS. 7 and 8, each end seal assembly 350 includes a backup seal 352 and an end seal 360. Each backup seal 352 is positioned against a surface of housing 332 located behind cleaner blade 314 including wall 333 at a respective longitudinal end of cleaner blade 314. Each backup seal 352 includes a front side 353 that faces toward PC drum 310 and a rear side 354 opposite front side 353 as well as an inboard side 355 that is axially inboard relative to PC drum 310 and an outboard side 356 that is axially outboard relative to PC drum 310. Each backup seal 352 also includes a top end 357 and a bottom end 358. Top end 357 is positioned upstream from bottom end 358 relative to the operative rotational direction 312 of PC drum 310. In one embodiment, backup seal 352 is composed of a relatively soft foam material, which may be an open cell foam.

End seals 360 contact the outer surface of PC drum 310 at the axial ends of PC drum 310 to prevent toner on PC drum 310 from migrating to the axial ends of the surface of PC drum 310. End seals 360 also extend along the axial edges of PC drum 310 and longitudinal edges of cleaner blade 314 to prevent toner from leaking beyond the axial edges of PC drum 310 and longitudinal edges of cleaner blade 314. Each end seal 360 includes a front side 361 that faces toward PC drum 310 and a rear side 362 opposite front side 361 as well as an inboard side 363 that is axially inboard relative to PC drum 310 and an outboard side 364 that is axially outboard relative to PC drum 310. Each end seal 360 also includes a top end 365 and a bottom end 366. Top end 365 is positioned upstream from bottom end 366 relative to the operative rotational direction 312 of PC drum 310. Each end seal 360 includes an outer leg 367 that forms the bottom end 366 of end seal 360 on its outboard side 364 and an inner leg 368 that forms the bottom end 366 of end seal 360 on its inboard side 363. In the embodiment illustrated, outer leg 367 extends further in the operative rotational direction 312 of PC drum 310 than inner leg 368. Inboard side 363 of the portion of outer leg 367 that extends past inner leg 368 extends along the axial edge of PC drum 310 and the longitudinal edge of cleaner blade 314 to prevent toner from leaking past the axial edge of PC drum 310 and the longitudinal edge of cleaner blade 314. The portion of the front side 361 of each end seal 360 proximate the inboard side 363 of the end seal 360 contacts the outer surface of PC drum 310 to prevent toner on PC drum 310 from migrating to the axial end of the surface of PC drum 310. In the embodiment illustrated, each end seal 360 includes a foam backing 369 and a lower friction (relative to the foam backing 369) felt or suede material 370 adhered on the front side of the foam backing 369. Foam backing 369 may be composed of a more firm foam material than backup seal 352 and may be composed of a closed cell foam. In some embodiments, the foam backing 369 and the felt/suede material 370 are laminated together forming a unitary construction. However, end seals 360 may have any suitable construction and may be formed of other suitable materials.

Figure 9:
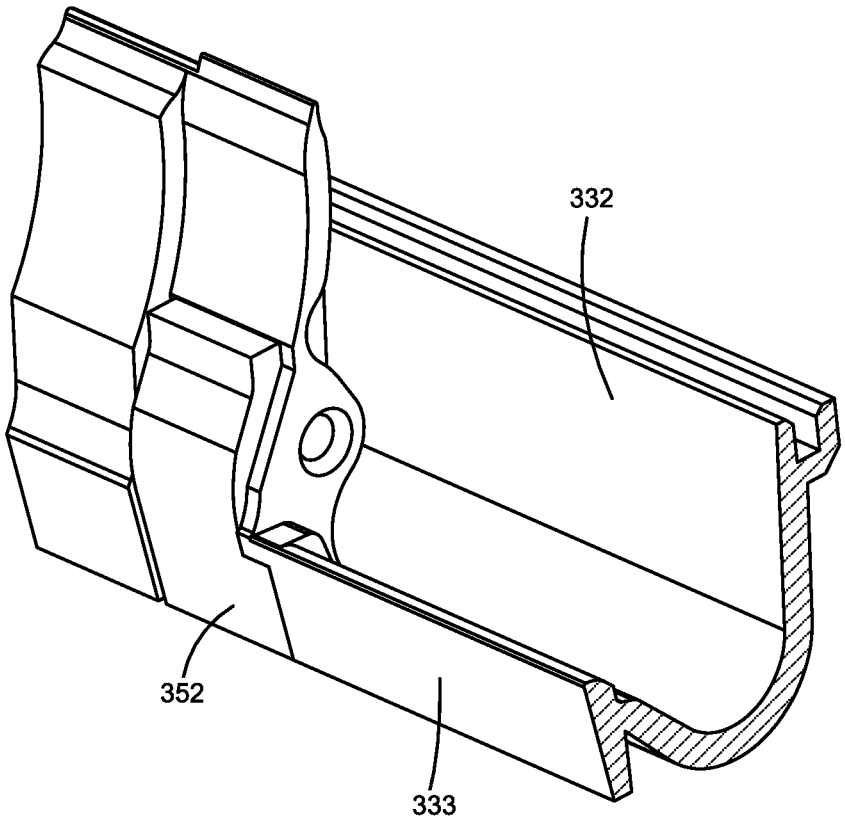
FIG. 9 is a perspective view of a backup seal of the end seal assembly positioned against a housing of the photoconductor unit according to one example embodiment.
Figure 10:
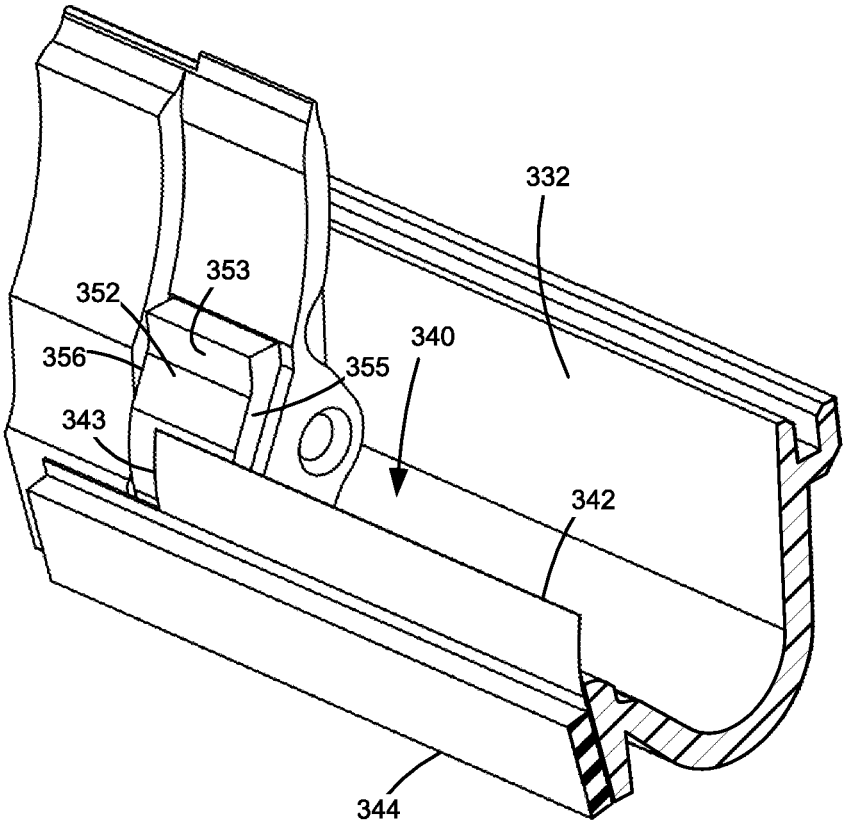
FIG. 10 is a perspective view of the rear seal assembly positioned relative to the backup seal according to one example embodiment.

FIGS. 8-11 illustrate the layering of rear seal assembly 340 and end seal assembly 350 at each axial end of PC drum 310 and longitudinal end of cleaner blade 314 to prevent against toner leakage according to one example embodiment. As discussed above, backup seal 352 is positioned against a surface of housing 332 located behind cleaner blade 314 at the longitudinal end of cleaner blade 314, including an axial end portion of wall 333. For example, FIG. 9 shows backup seal 352 positioned against housing 332 with all other components removed FIG. 10 shows rear seal assembly 340 positioned relative to backup seal 352. As shown in FIG. 10, at the axial ends of PC drum 310 and longitudinal ends of cleaner blade 314, a rear side of rear seal assembly 340 is positioned against front side 353 of a bottom portion of backup seal 352. A longitudinal end 343 of film seal 342 is positioned axially between inboard side 355 and outboard side 356 of backup seal 352. In the embodiment illustrated, foam seal 344 (and the portion of film seal 342 positioned on the rear side of foam seal 344) extends further axially outboard than backup seal 352.

Figure 11:
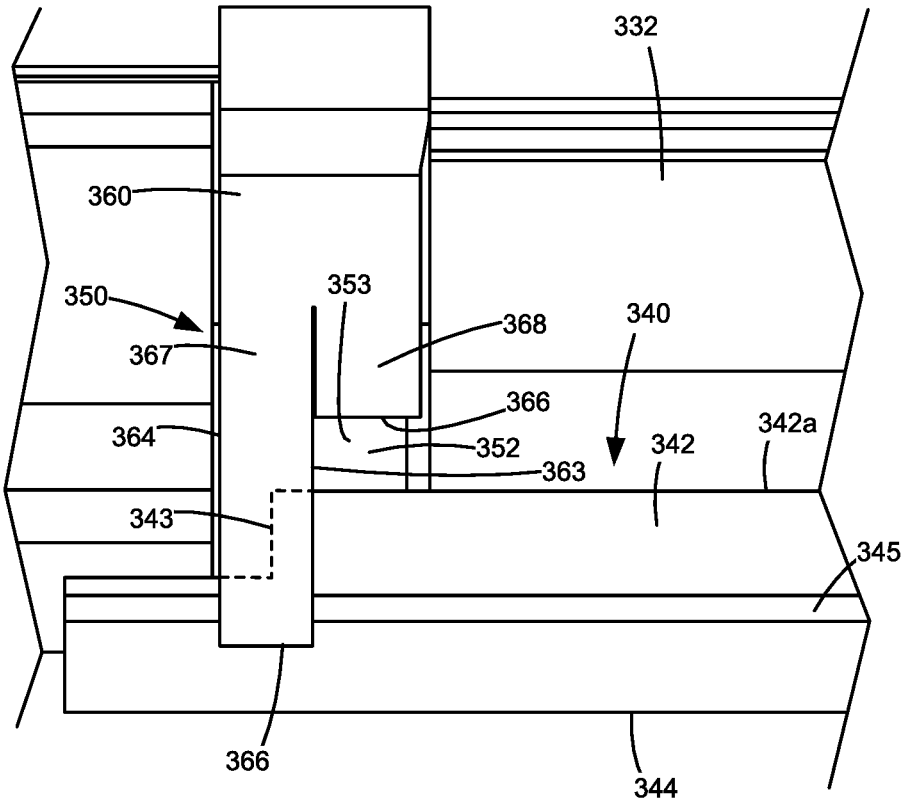
FIG. 11 is a front elevation view of an end seal of the end seal assembly positioned relative to the rear seal assembly and the backup seal according to one example embodiment.

FIG. 11 shows end seal assembly 350 and rear seal assembly 340 at one axial end of PC drum 310 and longitudinal end of cleaner blade 314 with PC drum 310, cleaner blade 314 and bracket 316 omitted for clarity. Rear side 362 of end seal 360 is positioned against front side 353 of backup seal 352. An upper portion of end seal 360 may extend above top end 357 of backup seal 352 with rear side 362 of the upper portion of end seal 360 positioned against housing 332. Longitudinal end 343 of film seal 342 (indicated in broken line in FIG. 11) is positioned axially between inboard side 363 and outboard side 364 of outer leg 367 such that rear side 362 of outer leg 367 lays on longitudinal end 343 of film seal 342. In this manner, longitudinal end 343 of film seal 342 is sandwiched between rear side 362 of outer leg 367 of end seal 360 and front side 353 of backup seal 352 in order to prevent toner from leaking from longitudinal end 343 of film seal 342. In the embodiment illustrated, bottom end 366 of outer leg 367 has an interference contact with a top end 345 of foam seal 344 forming a continuous seal for waste toner sump 338 outboard of cleaner blade 314. In this embodiment, bottom end 366 of inner leg 368 is spaced above free end 342*a* of film seal 342 and free end 314*c* of cleaner blade 314 so that end seal 360 does not apply an undesired force to free end 314*c* of cleaner blade 314.

Figure 12:
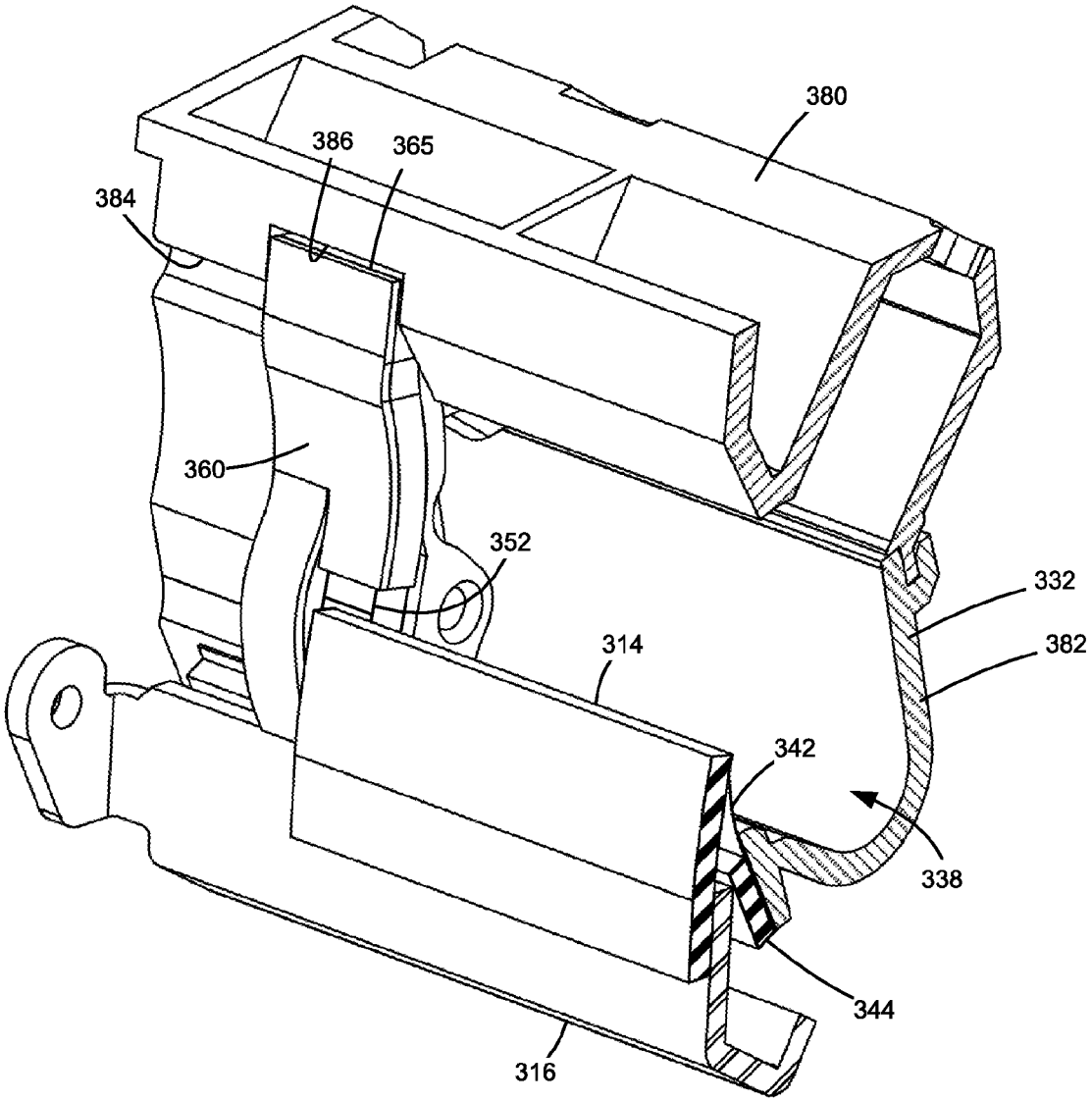
FIG. 12 is a perspective view of a portion of the end seal assembly showing a top portion of the end seal sealing a joint between a cap and a main body of the housing of the photoconductor unit according to one example embodiment.

With reference to FIGS. 5 and 12, in some embodiments, housing 332 includes a lid or cap 380 attached to a main body 382 of housing 332. In one embodiment, cap 380 retains a supply of lubricant, for example, zinc stearate, to be applied to the surface of PC drum 310 during operation. In the embodiment illustrated, cap 380 extends along the axial length of PC drum 310 and is positioned upstream from cleaner blade 314 relative to the operative rotational direction 312 of PC drum 310.

Figure 13:
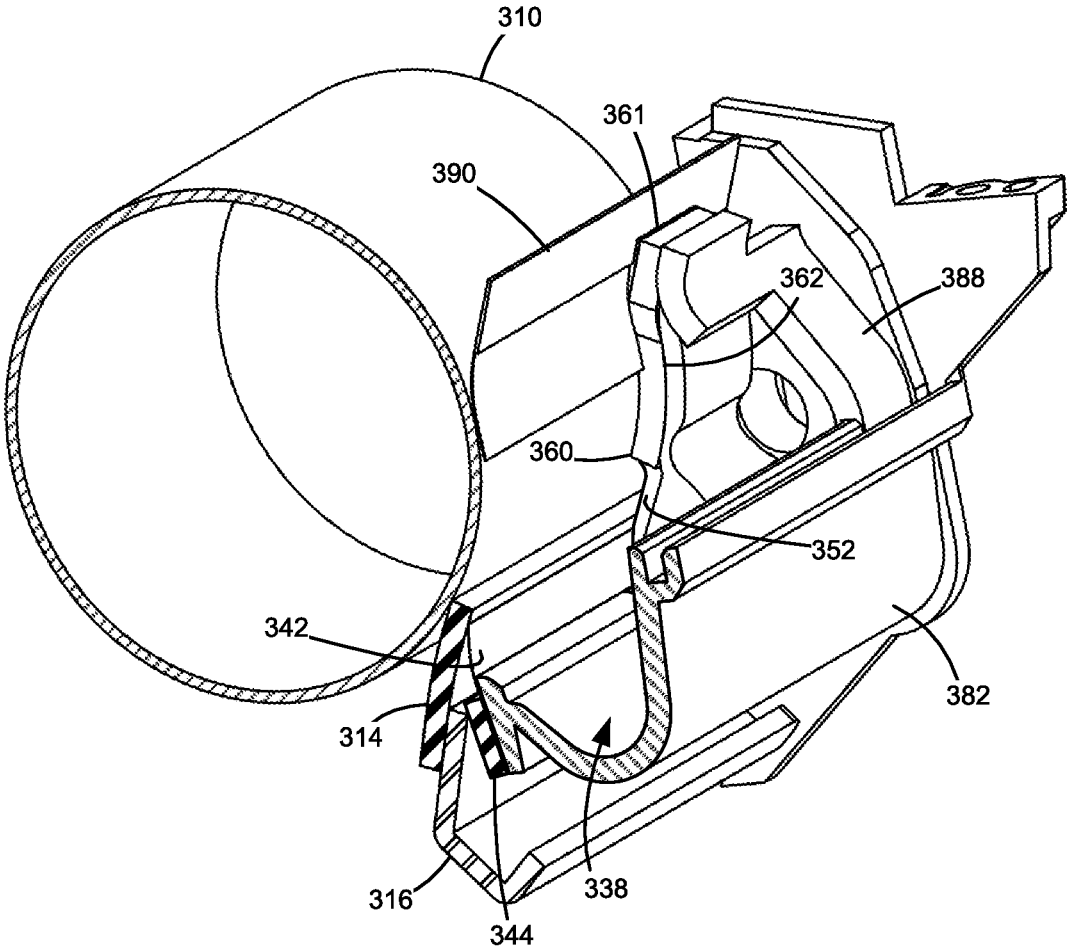
FIG. 13 is a cross sectional perspective view of a portion of the photoconductor unit showing the end seal positioned against a seal that is positioned between the cap and the main body of the housing of the photoconductor unit according to one example embodiment.

As shown in FIG. 12, in the embodiment illustrated, a seam or joint 384 is formed where cap 380 meets main body 382 on the front of housing 332. In this embodiment, top end 365 of end seal 360 extends above joint 384 and into a recess 386 formed on the front of cap 380. FIG. 13 shows an axial end portion of housing 332 with cap 380 removed. As shown in FIG. 13, housing 332 may include a seal 388 positioned between main body 382 and cap 380 at each axial end of housing 332 (relative to the rotational axis of PC drum 310). In the embodiment illustrated, rear side 362 of the portion of end seal 360 positioned in recess 386 is positioned against seal 388 forming a continuous seal for waste toner sump 338 at joint 384 formed by cap 380 and main body 382.

As shown in FIGS. 5 and 13, housing 332 may include an entry seal 390 that extends along the axial length of PC drum 310, from the end seal 360 at one end to the end seal 360 at the other end. Entry seal 390 is positioned upstream from cleaner blade 314 relative to the operative rotational direction 312 of PC drum 310 to provide additional sealing of waste toner sump 338. A lubricant brush may extend along the length of PC drum 310 and be positioned between entry seal 390 and cleaner blade 314 to apply a lubricant, e.g., zinc stearate, to the surface of PC drum 310 during operation. In the embodiment illustrated, entry seal 390 is positioned across front side 361 of the portion of end seal 360 positioned in recess 386. In the embodiment illustrated, entry seal 390 includes a flexible film composed of, for example, Mylar or urethane.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A photoconductor unit for an electrophotographic image forming device, comprising:

a housing;

a photoconductive drum rotatably mounted on the housing, the photoconductive drum includes a rotational axis;

a cleaner blade extending longitudinally along the rotational axis of the photoconductive drum and including a pair of longitudinal ends, the cleaner blade includes a front side that faces the photoconductive drum and a rear side opposite the front side, the cleaner blade extends upward in a cantilevered manner toward the photoconductive drum and includes a cleaning edge that contacts a surface of the photoconductive drum to remove toner from the surface of the photoconductive drum;

a waste toner sump positioned adjacent to the rear side of the cleaner blade that stores toner removed from the surface of the photoconductive drum by the cleaner blade; and a rear seal assembly that seals between the rear side of the cleaner blade and a wall of the housing that is positioned proximate to a front portion of the waste toner sump, the rear seal assembly includes:

a film seal that extends in a cantilevered manner toward the rear side of the cleaner blade and that contacts the rear side of the cleaner blade along a longitudinal length of the cleaner blade; and a second seal positioned between the rear side of the cleaner blade and the wall of the housing below the contact between the rear side of the cleaner blade and the film seal, the second seal extends along the longitudinal length of the cleaner blade.

2. The photoconductor unit of claim 1, wherein the cleaner blade is mounted on a bracket that is mounted on the housing, the cleaner blade and the bracket are pivotable relative to the photoconductive drum about a pivot axis that is parallel to the rotational axis of the photoconductive drum, wherein the second seal is a foam seal that is positioned against the bracket.

3. The photoconductor unit of claim 2, wherein the foam seal has an interference contact with a top, rear edge of the bracket.

4. The photoconductor unit of claim 1, wherein the cleaner blade is mounted on a bracket that is mounted on the housing, the cleaner blade and the bracket are pivotable relative to the photoconductive drum about a pivot axis that is parallel to the rotational axis of the photoconductive drum, a direction of force of the second seal on the bracket is below the pivot axis and a direction of force of the film seal on the cleaner blade is above the pivot axis.

5. The photoconductor unit of claim 1, further comprising an end seal assembly at each longitudinal end of the cleaner blade, each end seal assembly includes:

a backup seal positioned against a portion of the housing that is adjacent to the rear side of the cleaner blade; and an end seal that includes a front side and a rear side opposite the front side, at least a portion of the front side of the end seal contacts the surface of the photoconductive drum, the rear side of the end seal faces toward a front side of the backup seal, wherein each longitudinal end of the film seal is sandwiched between the front side of the backup seal and the rear side of the end seal at a respective longitudinal end of the cleaner blade.

6. The photoconductor unit of claim 5, wherein each longitudinal end of the film seal is positioned intermediate an axially inboard side of the end seal and an axially outboard side of the end seal and intermediate an axially inboard side of the backup seal and an axially outboard side of the backup seal.

7. A photoconductor unit for an electrophotographic image forming device, comprising:

a housing;

a photoconductive drum rotatably mounted on the housing, the photoconductive drum includes a rotational axis;

a cleaner blade mounted on a bracket that is mounted on the housing, the cleaner blade extends longitudinally along the rotational axis of the photoconductive drum and includes a pair of longitudinal ends, the cleaner blade includes a front side that faces the photoconductive drum and a rear side opposite the front side, the cleaner blade extends in a cantilevered manner from the bracket toward the photoconductive drum and includes a cleaning edge that contacts a surface of the photoconductive drum to remove toner from the surface of the photoconductive drum, the cleaner blade and the bracket are pivotable relative to the photoconductive drum about a pivot axis that is parallel to the rotational axis of the photoconductive drum; and a rear seal assembly that seals between the rear side of the cleaner blade and a wall of the housing, the rear seal assembly includes:

a film seal that extends in a cantilevered manner toward the rear side of the cleaner blade and that contacts the rear side of the cleaner blade along a longitudinal length of the cleaner blade; and a foam seal positioned between the rear side of the cleaner blade and the wall of the housing, the foam seal extends along the longitudinal length of the cleaner blade and is positioned against the bracket.

8. The photoconductor unit of claim 7, wherein the foam seal has an interference contact with a rear edge of the bracket.

9. The photoconductor unit of claim 7, wherein a direction of force of the foam seal on the bracket and a direction of force of the film seal on the cleaner blade are on opposite sides of the pivot axis.

10. The photoconductor unit of claim 7, further comprising an end seal assembly at each longitudinal end of the cleaner blade, each end seal assembly includes:

a backup seal positioned against a portion of the housing that is adjacent to the rear side of the cleaner blade; and an end seal that includes a front side and a rear side opposite the front side, at least a portion of the front side of the end seal contacts the surface of the photoconductive drum, the rear side of the end seal faces toward a front side of the backup seal, wherein each longitudinal end of the film seal is sandwiched between the front side of the backup seal and the rear side of the end seal at a respective longitudinal end of the cleaner blade.

11. The photoconductor unit of claim 10, wherein each longitudinal end of the film seal is positioned intermediate an axially inboard side of the end seal and an axially outboard side of the end seal and intermediate an axially inboard side of the backup seal and an axially outboard side of the backup seal.

12. A cleaner assembly for an electrophotographic image forming device, comprising:

a cleaner blade having a pair of longitudinal ends, the cleaner blade extends upward in a cantilevered manner and includes a cleaning edge that extends between the pair of longitudinal ends for contacting a surface to remove toner from the surface;

a waste toner sump positioned adjacent to a rear side of the cleaner blade, the waste toner sump stores toner removed from the surface by the cleaner blade; and a seal assembly that seals between the rear side of the cleaner blade and a wall of the waste toner sump, the seal assembly includes:

a film seal that extends in a cantilevered manner toward the rear side of the cleaner blade and that contacts the rear side of the cleaner blade along a longitudinal length of the cleaner blade; and a foam seal positioned between the rear side of the cleaner blade and the wall below the contact between the rear side of the cleaner blade and the film seal, the foam seal extends along the longitudinal length of the cleaner blade.

13. The cleaner assembly of claim 12, wherein the cleaner blade is mounted on a bracket, the cleaner blade and the bracket are pivotable about a pivot axis, wherein the foam seal is positioned against the bracket.

14. The cleaner assembly of claim 13, wherein the foam seal has an interference contact with a top, rear edge of the bracket.

15. The cleaner assembly of claim 13, wherein a direction of force of the foam seal on the bracket is below the pivot axis and a direction of force of the film seal on the cleaner blade is above the pivot axis.

* * * * *